US005839502A

United States Patent [19]

Ayata et al.

[11] Patent Number: 5,839,502

[45] Date of Patent: Nov. 24, 1998

[54] METHOD OF CONTINUOUS CASTING

[75] Inventors: Kenzo Ayata; Hideo Mori, both of Kakogawa; Susumu Ishiguro, Takasago; Masaki Nitta, Kakogawa, all of Japan

[73] Assignee: Kabushiki Kaisha Kobe Seiko Sho, Kobe, Japan

[21] Appl. No.: 746,492

[22] Filed: Nov. 12, 1996

[30] Foreign Application Priority Data

Feb. 19, 1996 [JP] Japan ..... 8-031009
Apr. 2, 1996 [JP] Japan ..... 8-080214

[51] Int. Cl.[6] ..... B22D 11/12; B21B 1/46

[52] U.S. Cl. ..... 164/476; 164/417

[58] Field of Search ..... 164/476, 417; 29/527.7

[56] References Cited

U.S. PATENT DOCUMENTS 4,687,047 8/1987 Ogibayashi ..... 164/476
5,634,513 6/1997 Ishiguro et al. ..... 164/476

FOREIGN PATENT DOCUMENTS 3-90261 4/1991 Japan ..... 164/476
6-262320 9/1994 Japan ..... 164/476

*Primary Examiner*—Patrick Ryan
*Assistant Examiner*—I. H. Lin
*Attorney, Agent, or Firm*—Oblon, Spivak, McClelland, Maier & Neustadt, P.C.

[57] ABSTRACT

In a method of continuous casting for rolling down a cast strand at the final stage of solidification to reduce segregation and center porosity at the center of the casting as much as possible and in particular prevent spot-shaped segregation, the rolling down is started after the center solid phase ratio of the casting reaches 0.2 and the rolling down is executed so as to compensate the total amount of volume contraction by solidification and cooling of strand in the section of the rolling down until the center solid phase ratio reaches 0.9 and thereafter the rolling down in continuously executed by a rolling down gradient of 0.08%/m or more to 1.5%/m or less.

4 Claims, 5 Drawing Sheets

METHOD OF CONTINUOUS CASTING

BACKGROUND OF THE INVENTION

1. Field of the Invention

The present invention relates to a method of continuous casting capable of reducing segregation as much as possible, and more specifically, to a method of continuous casting capable of manufacturing homogenous steel by preventing alloy elements such as C, Mn, Si, P, S etc. from segregating at the central portion of the casting in the thickness direction thereof.

2. Description the Related Arts

One of the important problems of a method of continuous casting is how to reduce segregation and center porosity made at the central portion of a casting.

To prevent the segregation, an electromagnetic stirring technology and a low temperature casting have been applied. They are based on a segregation dispersing technology for creating a large amount of equiaxed crystals, and further a high level purifying process is introduced to reduce the impure elements (in particular, P, S etc.) in molten steel and a technology which prevents bulging of unsolidified cast strand by the employment of closely arranged small diameter rolls is introduced, and these countermeasures have achieved considerable results, respectively.

However, when attention is paid to the end of solidification, there is not yet established a satisfactory solution as to the segregation caused by the flow of molten steel and the formation of center porosity at the end of the solidification resulting from the volume contraction during solidification.

To solve this problem, the recent method of continuous casting proposes to provide a plurality of rolling down rolls at the final stage of a casting process to thereby rolling down a cast strand in which unsolidified portion remains at the central portion thereof at the end of solidification at a low rolling gradient. When the cast strand is rolled down at the low rolling gradient, segregation is prevented by restricting the above flow of the molten steel as well as the center porosity is prevented by compensating the volume contraction during solidification, whereby a continuously cast product without casting defect can be provided.

Technologies for executing rolling down at the low rolling gradient are known, for example, from Japanese Examined Patent Publication No. 59-16862, Japanese Examined Patent Publication No. 3-6855, Japanese Examined Patent Publication No. 3-8863, Japanese Examined Patent Publication No. 3-8864, Japanese Examined Patent Publication No. 4-20696, Japanese Examined Patent Publication No. 4-22664 and Japanese Examined Patent Publication No. 5-30548. These known technologies have proposed several concepts (way of thinking using a change of a solid phase ratio at the central portion of a casting as a reference) as to the section in which rolling down is executed (section from time at which rolling down is started at the end of a drawing process taking the unsolidified state at the central portion of the casting into consideration to the time at which the rolling down is finished, the term "section" is used in the same meaning in the following description). When these technologies are generally reviewed, they have a common concept in that the time at which the solid phase ratio at the central portion is made high in the latter half of the drawing process, that is, the time at which a center solid phase ratio has reached, for example, 0.8 to 0.9 is recognized as the time when the limit of flow of molten steel is reached even if there remains unsolidified molten steel and rolling down is stopped or executed in a slight amount thereafter.

The creation and growth of solidifying crystal in continuous casting will be described here as to the casting of slab. First, a lot of crystal nuclei are produced in the vicinities of the four surfaces of the slab and then they start to grow as columnar crystals approximately in the directions perpendicular to the surfaces (toward the center of the slab), respectively. As a result, when the longitudinal cross sectional view of the slab is observed, there is formed a solidified structure (columnar crystal structure) in which a lot of the respective crystals extend like columns in contact with one another from the surfaces of the slab toward the center thereof and the extension of the crystals is stopped when the extreme ends of the respective columnar crystals (solidified front surfaces) are collided with one another in confrontation on a straight line passing through the center of the slab. When the state of the growth of the crystals is observed in a micro scale, however, the speeds at which adjacent columnar crystals grow are not always the same actually, thus lines connecting the extreme ends of crystals in the vicinity of the end of the growth (vicinity of the terminal point of solidification) to the extreme ends of adjacent columnar crystals exhibit a zigzag state. When the growth of the crystals is further proceeded in this state and there is reached the time at which the extreme ends of the confronting crystals having higher growing speeds start to be collided with one another, a liquid staying portion where the liquid phase of unsolidified molten steel remains is made at the extreme ends of uncollided crystals as shown in FIG. 1(B). Impure elements such as P, S etc. whose solidification is delayed are melted in this portion in a concentrated state. Since the flow of the unsolidified molten steel is restricted in this state, when solidification is finished in this state, there are formed spot-shaped segregation as shown in FIG. 1(C).

However, when the slab is further rolled down, the above liquid staying portion is destroyed by the rolling down and a portion of the unsolidified molten steel in which the impure elements are concentrated two-dimensionally spreads so as to pass through the intervals of the extreme ends of the collided crystals along a solidified front surface (when the unsolidified steel is observed on the cross section perpendicular to the paper, it spreads in a network-shape) and the solidification of the steel is finished in the state. As a result, there is formed a line-shaped segregation made by a relatively thick line, that is, a segregation line as shown in FIG. 1(D).

When the line-shaped segregation is formed, since hydrogen induced cracking is liable to be caused from the segregated portion, it is required to avoid the formation of the line-shaped segregation in, for example, pipe line steel. Consequently, it is proposed not to execute rolling down in the state that the solid phase ratio increases at the central portion and the fluidity of unsolidified steel is restricted thereby.

On the other hand, in the continuous casting of bloom having a large lateral cross sectional area, there is created the zone of equiaxed crystals exceeding about 10% of the width of a casting at the axial central portion of the casting by the application of the electromagnetic stirring technology and the low temperature casting technology in a casting mold. When rolling down is stopped in the casting at the time at which the center solid phase ratio is made high likewise the above continuous casting of slab, the aforesaid spot-shaped segregation is made relatively large and formed up to, for example, a size as large as 3 to 5 mm. When such large spot-shaped segregation is formed, since the portion contains impure elements of high concentration, there is an increased danger of causing an accident of wire breaking starting from the segregated portion in a high carbon steel material such as steel used to a tire code and spring steel in the cold processing effected in a post process. This problem also appears in the case in which the segregation dispersion technology making use of the production of a lot of equiaxed crystals is applied to the casting of slab.

SUMMARY OF THE INVENTION

An object of the present invention made taking the above circumstances into consideration is to provide a continuous casting method by which a lot of equiaxed crystals are formed at the axial center of a casting and, in particular, a method of not only preventing the segregation caused by the flow of molten steel and the formation of center porosity at the end of solidification resulting from the volume contraction during solidification when a bloom is continuously cast but also improving spot-shaped segregation caused by the unsolidified liquid phase portion remaining in a solidification end portion.

According to the present invention capable of solving the above problems, there is provided a method of continuous casting by which a lot of equiaxed crystal zones are formed at the axial center portion of a casting and in particular a method of continuous casting a bloom, wherein the gist of the invention is such that the casting is rolled down between confronting rolls so as to compensate the total amount of volume contraction by solidification and cooling of the casting strand in the region from the position where the solid phase ratio at the central portion of the casting is 0.2 to the position where the solid phase ratio is 0.8 to 0.9 and the casting is continuously rolled down at a ratio so that the rolling gradient (%/m) showing the ratio of the amount of rolling down (%: value determined by dividing the amount of rolling down by the original thickness of the casting and multiplying the divided value by 0.100) to be executed in the thickness direction of the casting per unit length thereof in the drawing direction thereof (unit: meter), is 0.08%/m or more and 1.50%/m or less and preferably 0.30%/m or more and 1.50%/m or less in the region following the above region until solidification is finished.

Note, it is preferable that the rolling down executed in the region from the position where the solid phase ratio at the central portion is 0.2 to the position where the solid phase ratio is 0.9 is executed so that the rolling gradient satisfies the following conditions (A), (B), (C), (D), and (E) while the value of the center solid phase ratio of the casting is in the following regions (1), (2), (3), (4), (5).

rolling gradient (%/m)=0.70 to 0.90 (A)

in a range (1): 0.2≦center solid phase ratio<0.35;

in a range (2): 0.35≦center solid phase ratio≦0.45;

rolling gradient (%/m)=0.30 to 0.90 (B)

rolling gradient (%/m)=0.30 to 0.48 (C)

in a range (3): 0.45<center solid phase ratio<0.65; and in a range (4): 0.65≦center solid phase ratio≦0.75;

rolling gradient (%/m)=0.08 to 0.48 (D)

rolling gradient (%/m)=0.08 to 0.16 (E)

in a range (5): 0.75<center solid phase ratio<0.9

That is, there is provided the region divided into at least five portions in correspondence to the growth of solidification and continuous casting is executed by changing the rolling down gradient to smaller values (A)→(B)→(C)→(D)→(E).

Although the conditions of equipment for executing the rolling down according to the present invention are not restricted at all, rolling down is executed by causing rolling down rolls or a rolling down roll each having a rolling effect exhibiting effective length 0.2 to 0.8 times that of the width of the casting to act on the casting from both the upper and lower sides or any one of the sides thereof in the region located after the timing at which the center solid phase ratio becomes 0.35 to 0.45.

Note, although the present invention exhibits its effect most remarkably when a bloom composed of high carbon steel is continuously cast, the technological range of the present invention is not particularly limited thereby.

DESCRIPTION OF THE PREFERRED EMBODIMENT

Figures 1A, 1B, 1C, 1D:
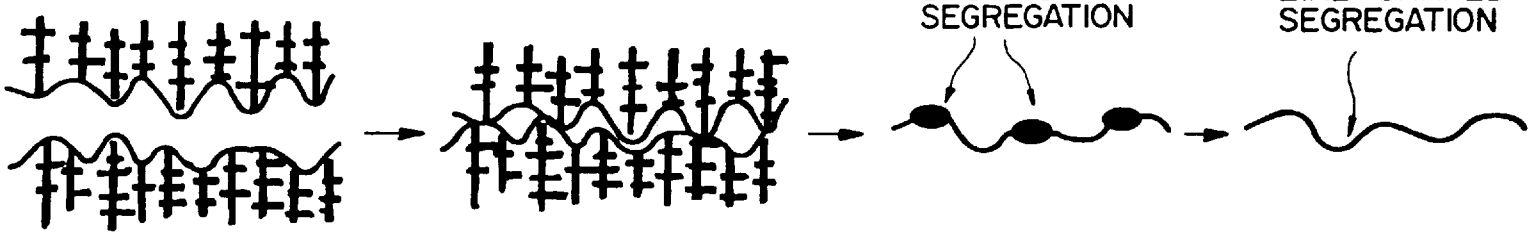
FIG. 1 is a view explaining the change of segregation modes caused by rolling down in the solidification of columnar crystals.

The present invention roughly divides an area in which a casting is rolled down into two sections. The first section is a region from a position where rolling down is executed with the solid phase ratio at the central portion of the casting set to 0.2 to a position where rolling down is executed with the solid phase ratio set to 0.9 and the casting is rolled down in the region so as to compensate the total amount of volume contraction during solidification. The next section following to the first section is a region where rolling down is continuously executed until solidification is finished. In the second section, rolling down is executed so that a rolling gradient (%/m), which indicates the ratio of the amount of rolling down (%) to be executed in the thickness direction of the casting per unit length thereof in the drawing direction thereof (unit: meter), is 0.08%/m or more and 1.50%/m or less and preferably 0.30%/m or more and 1.50%/m or less.

The solid phase ratio at the central portion used here can be determined by carrying out non-steady state heat transfer analysis by computer simulation based on a finite element method, a finite differential method or the like using the relationship between the solid phase ratio and a temperature which takes a micro segregation analysis into consideration which can be determined according to the method described in the following literature.

"Tetsu-to-Hagane", 1992, Vol. 2, pages 275–281

In the present invention, the first section starts from the position where the thus determined center solid phase ratio is 0.2, "in other words, from the position where the solid phase ratio exhibits the value of 0.2 at the central portion of the casting or if necessary from a position a little upper stream side than the above position (on the casting mold side)" as well as rolling down starts therefrom. The rolling down in the first section is executed so as to compensate the total amount of volume contraction by solidification and cooling of the casting strand in the region. Rolling down conditions are not particularly limited so long as the above condition is kept. However, since the center solid phase ratio gradually increases on the downstream side of the drawing process of the casting, it is preferable that the rolling down in the first section of the present invention is continued until the center solid phase ratio reaches 0.9 while selecting an optimum rolling down gradient which is selected to be reduced in correspondence to the increase of the center solid phase ratio. The preferable rolling down conditions in the first section will be further described later.

Next, rolling down conditions after the center solid phase ratio has reached 0.9, (when they are more strictly defined, 0.90), that is, rolling down conditions for improving spot-shaped segregation will be described.

Figures 2A, 2B, 2C, 2D:
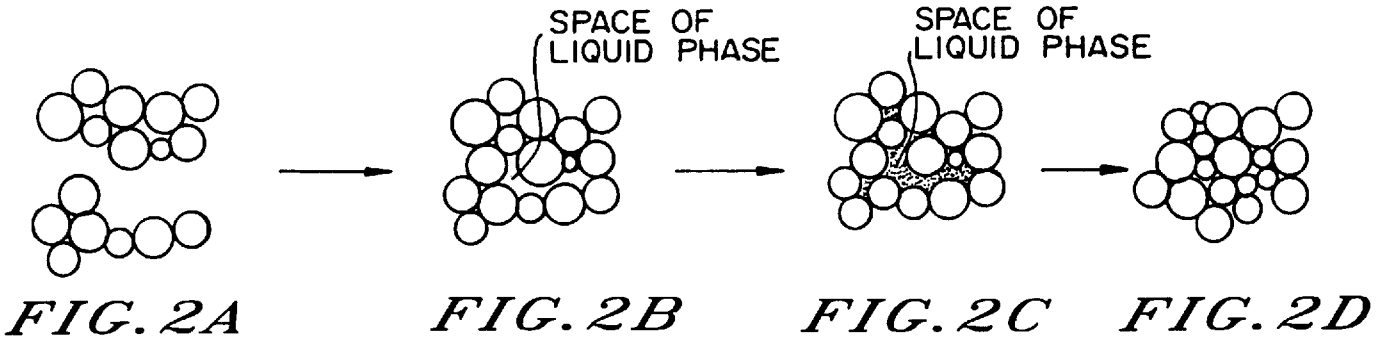
FIG. 2 is a view explaining the change of segregation modes caused by rolling down in the solidification of equiaxed crystals.

FIG. 2 is a view schematically showing how crystals are created at the end of solidification in ordinary continuous casting of a bloom. In the drawing, a lot of grain-shaped crystals called equiaxed crystals are created and unsolidified liquid phases in which impure elements are concentrated remain among them. When rolling down is executed under the rolling down conditions regulated by the present invention in this state, impure-elements-rich molten steel widely spreads three-dimensionally so as to break through among the grains of the equiaxed crystals and exude among the grains. As to this point, in the columnar crystal solidification shown in FIG. 1, since the dispersion made by the rolling down executed in the state that unsolidified liquid phases remain is made two-dimensionally as mentioned above, although a degree of dispersion of segregation to which the present invention pays attention is relatively small, the effect of dispersion in the case of the equiaxed crystal solidification in which dispersion is made three-dimensionally is greatly enhanced. Further, in the equiaxed crystal solidification, the three-dimensionally exuded impure-elements-rich molten steel is mixed with micro segregations which originally exist among the grains of the equiaxed crystals and cannot be distinguished from one another, thus there is almost no possibility that a clear segregation line which is formed in the case of the columnar crystal solidification is made. Therefore, in the continuous casting in which a lot of equiaxed crystal solidification is made as in the case of the continuous casting of the bloom, it is preferable that rolling down is continuously executed even after the center solid phase ratio exceeds 0.9.

Next, as a result of various examinations of a degree of rolling down to be executed after the center solid phase ratio has reached 0.9, it has been found that control is preferably executed in accordance with the concept of the aforesaid rolling gradient. A preferable range of the rolling gradient is 0.08%/m or more to 1.50%/m or less and when the rolling gradient is less than 0.08%/m, it is only capable of slightly deforming unsolidified liquid phase portions and is insufficient to cause the portions to disperse by breaking though among the grains of the equiaxed crystals. On the other hand, although the upper limit of the rolling dispersion is not regulated in the point of the dispersing effect of the impure-elements-rich molten steel, this effect is saturated in the vicinity of 1.50%/m. Rather, when this value is exceeded, since there is a possibility that a casting is unnecessarily deformed, it is preferable to set the aim of the upper limit to 1.50%/m. Note, the rolling gradient is more preferably 0.30%/m to 1.50%/m.

Next, there will be described the rolling down conditions in the first section which starts from the position where the center solid phase ratio is 0.2, "in other words, from the position where the solid phase ratio exhibits the value of 0.2 at the central portion of the casting or if necessary from a position a little upper stream side than the above position (on a casting mold side)". Rolling down in this section is executed so as to compensate the total amount of volume contraction by solidification and cooling of the cast strand as described above. However, it is recommended that the rolling down is preferably continued while selecting an optimum rolling gradient which is selected to be reduced stepwise as described in the above formulas (A)–(E) in correspondence to the gradual increase of the center solid phase ratio toward the downstream side of the drawing process of a casting. When the above recommended conditions are kept, a casting without segregation can be made by preventing V-type segregation and further inverted V-type segregation which makes internal cracking and deteriorates segregation.

Note, when rolling down starts from an initial stage before the center solid phase ratio reaches 0.2, it is recommended that the rolling down is executed in accordance with the conditions of rolling gradient shown by the formula (A).

If rolling down starts after the center solid phase ratio has reached 0.2 (more strictly, 0.20), the possibility that segregation is caused by it is increased since volume contraction during solidification causes the flow of molten steel at the time the value 0.2 has been reached. However, there is a case that the timing at which rolling down starts may be delayed up to the position where the center solid phase ratio is 0.25 depending upon a type of steel. On the other hand, when rolling down is stopped at a position before the center solid phase ratio reaches 0.9, the formation of V-type segregation may not be avoided since the rolling down is released in the state that there remains a possibility that the flow of molten steel is caused by the volume contraction during solidification. Further, the danger that a large amount of center porosity is formed is increased since the volume contraction during solidification is not compensated.

As described before, the temperature of a casting is gradually lowered even while rolling down is continued, thus the center solid phase ratio increases. To cope with this problem, it is preferable in the present invention that a degree of rolling down is changed in a direction toward which it is reduced in accordance with an increase of the center solid phase ratio and the present invention employs a concept "rolling down gradient" to be described below to indicate the degree of rolling down.

The rolling down gradient is a numerical value indicating the degree of a rolling reduction (%) to be applied to a casting in the thickness direction thereof per unit length of the casting in the drawing direction thereof (unit: meter) and given by a unit of %/m.

V-type segregation is caused in such a manner that impure-elements-rich molten steel is flown and absorbed toward the central portion of a casting by the contraction in volume of the casting when the molten steel is solidified in the final stage of solidification of the casting. Therefore, the volume of the molten steel in the casting must be reduced by the amount corresponding to the contracted volume resulting from solidification to perfectly stop the flow of the molten steel, thus the solidified casting is rolled down for this purpose. However, since the amount of contraction of the volume in the solidification is reduced as the solidification proceeds, that is, as the center solid phase ratio increases, the inventors have found that it is preferable to reduce the rolling down gradient properly as the center solid phase ratio increases, that is, there exist proper rolling gradients shown by the formulas (A) to (E) in the aforesaid regions (1) to (5) and a reason why the above proper ranges of the rolling down gradient are determined is as mentioned below.

Region (1): 0.2≦center solid phase ratio≦0.35:

Solidification does not yet sufficiently proceed in this region and the molten steel in a casting exhibits high fluidity. Therefore, when the rolling down gradient is insufficient, more specifically, when it is less than 0.70%/m in this state, V-type segregation often remains by insufficient rolling down. However, when the rolling down gradient exceeds 0.9%/m, since the solidification front is excessively distorted, there is a danger that internal cracking is caused before the occurrence of inverted V-type segregation. Note, although there is not a significant meaning in functions and effects as to the application of rolling down at a position before the center solid phase ratio reaches 0.2, when the rolling down starts at a position after 0.2 has been reached, the aforesaid disadvantages are caused by the delay of start of the rolling down. Thus, it is recommended to start the rolling down just before the center solid phase ratio reaches 0.2. Therefore, the present invention does not exclude that the rolling down is executed before the center solid phase ratio reaches 0.2.

Region (3): 0.45<center solid phase ratio<0.65:

In this region, since solidification is more proceeded than that in the region (1) and solidified shells are fairly grown, the volume of an unsolidified portion is reduced and the amount of the volume contraction during solidification is reduced accordingly. Therefore, the lower limit of the rolling down gradient where insufficient rolling down is not caused is shifted downward as compared with the value determined in the region (1) and the lower limit where V-type segregation is difficult to be caused is 0.30%/m. On the other hand, the upper limit for preventing the danger of inverted V-type segregation caused by the reverse flow of molten steel due to excessive rolling down is set to 0.48%/m which is shifted downward from the value determined in the region of (1).

Range (5): 0.75<center solid phase ratio≦0.9:

In this region, solidification further proceeds and solidified shells are greatly grown. Thus, the lower limit of the rolling down gradient where V-type segregation is not caused by insufficient rolling down is further lowered to 0.08%/m and the upper limit thereof where inverted V-type segregation is not caused by the reverse flow of molten steel is also lowered up to 0.16%/m.

Range (2) and Range (4): it is possible to divide the regions with a relatively high flexibility taking it into consideration that the fluidity of molten steel changes depending upon the composition of steel in the vicinity of the center solid phase ratio of (0.35 to 0.45) and the vicinity thereof of (0.65 to 0.75). Therefore, it is permitted to give a larger degree of freedom to the division of the region itself as shown by the regions (2) and the region (4). In short, since the gist of the present invention is to reduce the rolling down gradient in the respective divided regions, an optimum rolling down gradient may be selected from the regions shown by the respective formulas (A), (B), (C), (D) and (E) in the respective regions according to the gist.

A rolling down roll used in the present invention is not particularly limited and any general-purpose flat roll and crown roll may be used in the present invention. However, what is more preferable is a short width roll developed by the inventors to be described later. That is, the flat roll and the crown roll have the following problems.

First, the flat roll has a problem that since the entire surface of a casting is rolled down including the shell portion exhibiting a high rigidity which is grown from both the sides of the casting toward the central portion thereof, there is a large rolling down resistance (this is particularly remarkable in a bloom casting having a small ratio of width to thickness) and thus a ratio (rolling down efficiency) effective to reduce the cross sectional area of the unsolidified portion of the casting at the central portion thereof is low. As a result, there is a problem that since a large amount of rolling down is needed to prevent segregation, a load imposed on the roll is increased, whereby the roll and bearings are greatly worn. Further, costs for equipment and operation are increased to cope with .a necessary amount of rolling down.

On the other hand, since the crown roll only the central portion of which has a larger diameter than both the ends thereof exhibits a rolling down action to the central portion of a casting at only the central portion of the roll, the rolling down resistance caused by the high rigidity of the above shell portion is reduced, thus it is evaluated that the rolling down efficiency is improved in a practical application and a high efficiency for preventing segregation and center porosity can be achieved even by a relatively small amount of rolling down. However, when it is intended to maintain a rolling down accuracy by minimizing the warp of the roll caused by heat transmitted from the casting, the diameter of both the ends of the roll must be considerably increased and the diameter of the central portion of the roller is increased accordingly, thus an interval (roll pitch) between the crown rolls adjacent to each other in the drawing direction of the casting is also increased. As a result, there is a problem that a phenomenon that the casting is bulged between the rolls by the static pressure of the molten steel in the casting is made remarkable and an effect for preventing segregation and center porosity is lost.

Taking the above problems into consideration, the inventors have developed a rolling down roll having an effective length 0.2 to 0.8 times the width of a casting (referred to as a short width roll in the specification) and filed a patent application for the roll (Japanese Unexamined Patent Publication No. 6-210420).

Figure 3:
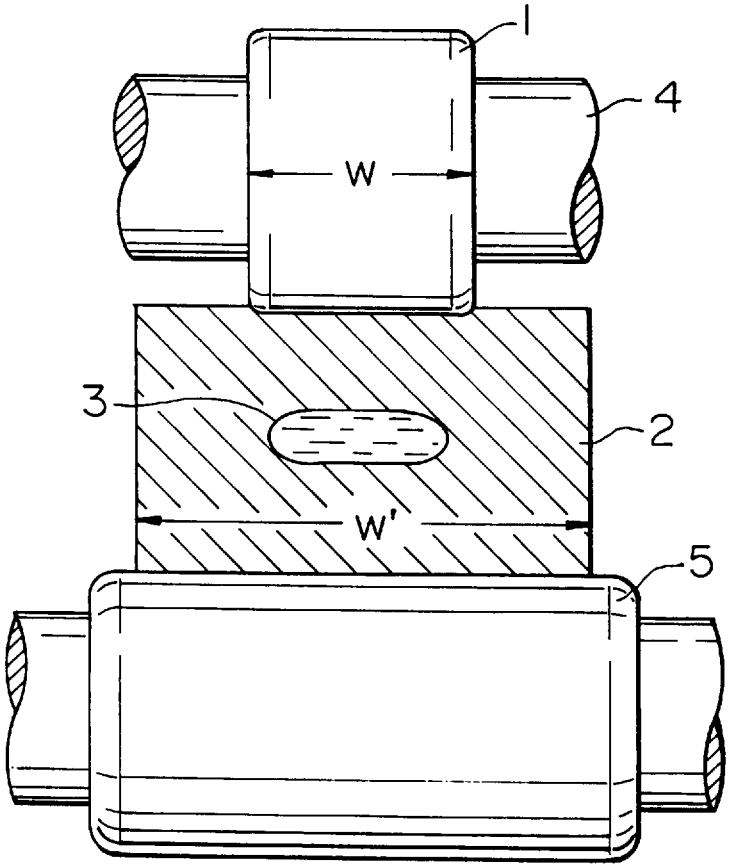
FIG. 3 is a view explaining how a short width roll is used in the present invention.

FIG. 3 is a view conceptually explaining how the short width roll of the present invention is used, wherein numeral 1 denotes the short width roll, numeral 2 denotes a casting, numeral 3 denotes an unsolidified portion, numeral 4 denotes a shaft, and numeral 5 denotes a flat roll. Although FIG. 3 shows a case that the short width roll is acted on the upper side of the casting 2 and the lower portion thereof is supported by the flat roll 5, the short width rolls having the same size may be acted on the upper and lower sides of the casting. Although the short width roll 1 already is described in detail in Japanese Unexamined Patent Publication No. 6-210420, what is preferably used is the short width roll 1 having an axial length W which is substantially shorter than the width W' of the casting 2 and in particular satisfying the following relationship.

$$0.2W' \leqq W \leqq 0.8W' \quad (P)$$

More preferable is the short width roll 1 which satisfies the following relationship.

$$0.3W' \leqq W \leqq 0.7W' \quad (Q)$$

Since the short width roll 1 has a short length in an axial direction, it exhibits sufficient rigidity even if it does not particularly have a large diameter. Therefore, since a roll diameter can be reduced and a roll pitch can be shortened accordingly, bulging which is a defect of prior art using the crown roll can be restricted. Note, it is recommended from the view point of the prevention of the bulging to set the roll pitch to 350 mm or less.

Further, as apparent from FIG. 3, since the short width roll of the present invention can effectively and intensively roll down the central portion of the casting where the unsolidified portion 3 exists, an amount of rolling down necessary to prevent segregation and center porosity can be reduced, by which an operation cost can be reduced. Further, since the friction of a roll surface and the roll shaft is reduced, a maintenance cost of equipment can be also reduced. Although the short width roll may be used in all the rolling down regions (1) to (5), since the short width roll is particularly effective to the rolling down of a casting having a reduced unsolidified portion, the short width roll is used only in the regions (2) to (3) and the regions thereafter and the conventional flat roll or crown roll may be used in the region (1).

When the above formula (P) is not satisfied, for example, when W is made smaller than 2W', since the unsolidified portion 3 cannot be rolled down over the entire width thereof, expected effects such as the prevention of segregation and the like cannot be sufficiently achieved. On the other hand, when W exceeds 8W', since the roll is subjected to a large resistance caused by solidified shells, it is difficult to achieve the prevention of the segregation and the like by the rolling down. Note, although it is preferable that the short width rolls are disposed to roll down the casting 2 from both the upper side and the lower side thereof or the short width roll of the present invention is disposed to any of the upper side and the lower side of the casting 2 and the other side of the casting 2 is supported by the aforesaid flat roll, it is not required to have the same arrangement over the entire length in the drawing direction of the casting and the above arrangements may be alternately employed by the change of design.

Further, although it has been found that the present invention is widely applicable from medium low carbon steel to high carbon steel regardless of the cross sectional shape and size of a casting and expected effects can be obtained in any case, the present invention can particularly exhibit remarkable effects in the continuous casting of a bloom composed of high carbon steel.

EXAMPLES

Figure 4:
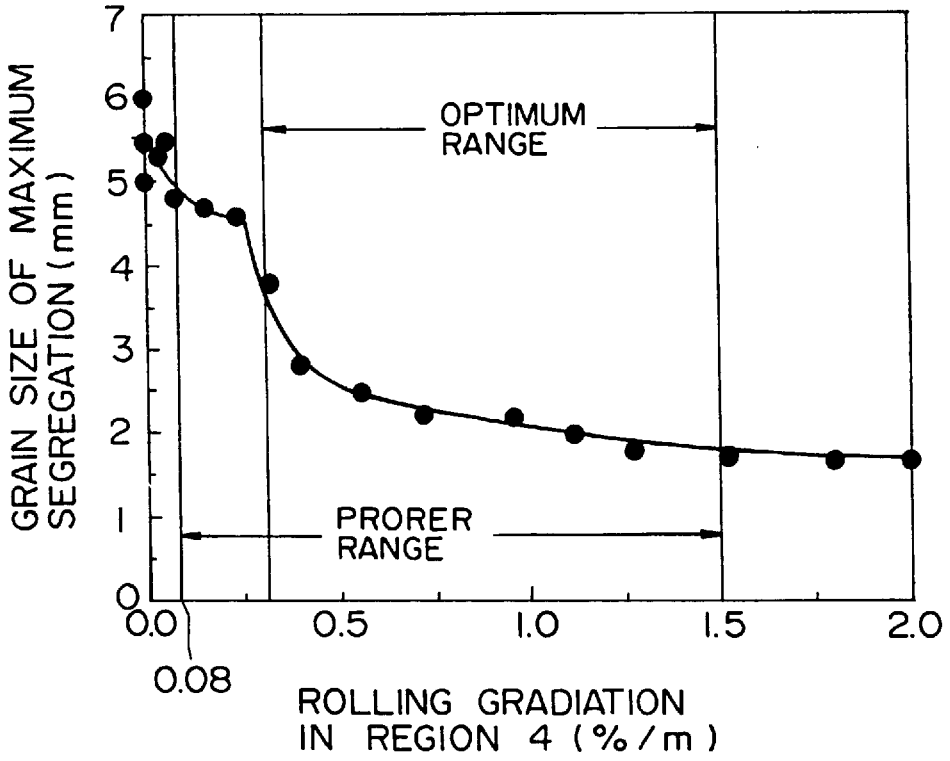
FIG. 4 is a graph showing the change of a maximum segregated grain size caused by the change of a rolling down gradient after a center solid phase ratio becomes 0.85.

Blooms each having a casting size of 380×600 (mm) were continuously cast using various types of steel having a carbon concentration of 0.71 to 0.82% (refer to Table 1) (also using electromagnetic stirring in a casting mold). Note, rolling down was executed using flat rolls on both the upper and lower sides in the region (1) and a short width roll having a width of 250 mm on the upper side and a flat roll on the lower side in the regions (2), (3), (4), (5), (6) (the region (6) was a region where the center solid phase ratio was 0.90 or more). Note, the roll gap between adjacent rolling down rolls (gap in the direction toward which the casting is drawn) was set to 320 mm. Table 2 shows the result of investigation of the center segregation in the regions (1) to (6) and the respective rolling down gradients (the rolling down gradient in the region (6) was variously changed as shown in FIG. 4).

TABLE 1

| | C | SI | Mn | P | S | Cr | Al |
|---|---|---|---|---|---|---|---|
| Type of Steel A | 0.71 to 0.73 | 0.18 to 0.25 | 0.45 to 0.55 | ≦0.010 | ≦0.005 | ≦0.03 | ≦0.003 |
| Type of Steel B | 0.81 to 0.83 | 0.18 to 0.25 | 0.45 to 0.55 | ≦0.010 | ≦0.005 | ≦0.03 | ≦0.003 |

(mass %)

TABLE 2

| Rolling Gradient (%/m) | | | | Result of Center Segregation V-type, |
|---|---|---|---|---|
| Region (1) | Region (2) Region (3) | Region (4) Region (5) | Region (6) | Inverted V-type Segregation |
| 0.74 | 0.37 | 0.12 | 0.02 to 2.00 | None |

FIG. 4 shows the result of measurement of the maximum egregated gain size measured at the central portion of a casting of 200 mm long whose longitudinal cross section was polished and corroded by saturated picric acid added ith a surfactant. When the rolling gradient in the region (4) is less than 0.08%/m, the grain size of spot-shaped segregation is not improved and the effect of improving it is admitted when the rolling down gradient exceeds 0.08%/m and the effect of improvement is remarkably exhibited when the rolling down gradient exceeds 0.30%/m. However, it is found that the effect is saturated when the rolling down gradient exceeds about 1.50%/m.

Figure 5A:
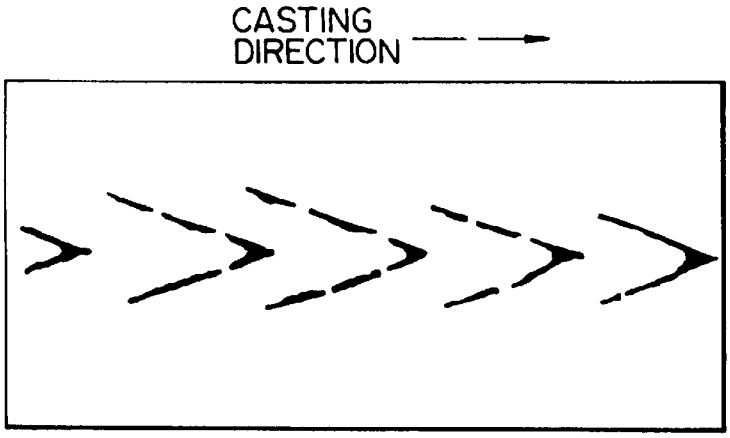
FIG. 5 is a view schematically explaining a macro structure at the central portion of the cross section of a casting.
Figure 5B:
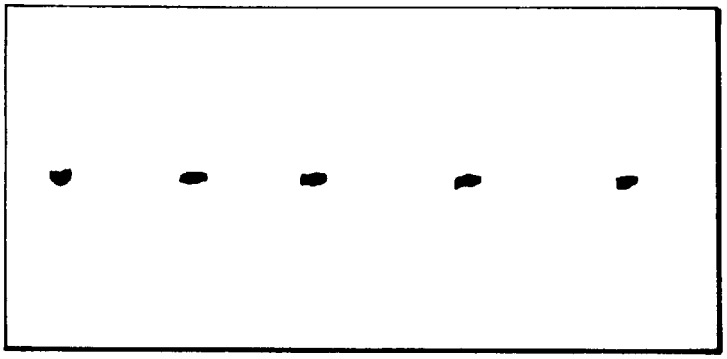
Figure 5C:
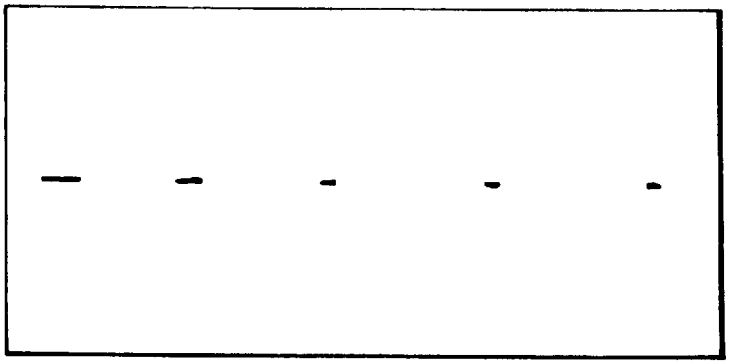

FIG. 5 schematically shows typical macro structures of the cross section of castings. Experiment (a) shows the macro structure of a casting to which no rolling down was executed, Experiment (b) shows the macro-structure of a casting to which the following preferable rolling down was applied in the regions (1) to (5) but no rolling down was applied in the region (6) and Experiment (c) shows the macro structure of a casting to which the following preferable rolling down was applied in all the regions (1) to (6), from which it is found that the macro-structure of the casting shown in FIG. 5(*c*) is most excellent.

Region (1) 0.74%/m (common to Experiments (b), (c))

Region (2), (3) 0.37%/m (common to Experiments (b), (c))

Region (4), (5) 0.12%/m (common to Experiments (b), (c))

Region (6) 0.50%/m (not rolled down in Experiment (b))

In Experiment (a), V-type segregation is caused in various portions of the casting as well as segregation as shown in FIG. 5(*a*) is admitted at the central portion of the casting and in Experiment (b), although V-type segregation and inverted V-type segregation are not admitted, spot-shaped segregation as shown in FIG. 5(*b*) is admitted at the central portion of the casting, whereas in Experiment (c), neither V-type segregation nor inverted V-type segregation is admitted in the casting as well as the central portion of the casting as shown in FIG. 5(*c*), thus a very slight amount of segregation is caused in the casting.

In the present invention arranged as described above, since rolling down is executed in the amount corresponding to the total amount of volume contraction by solidification and cooling of the cast strand in the regions where the center solid phase ratio is 0.2 to 0.9 and rolling down is also executed by a proper rolling down gradient in the regions at the end of solidification after the center solid phase ratio has rached 0.9, there can be made a casting to which not only V-type segregation, inverted V-type segregation and center porosity but also spot-shaped segregation at an axial center portion are not caused. In particular, although V-type segregation is remarkably caused conventionally at an axial center portion at the final stage of solidification by the movement of equiaxed crystals and the suction of impure-elements-rich molten steel resulting from volume contraction during solidification in the continuous casting of a bloom in which equiaxed crystals zone is widely formed, it has been confirmed that the present invention exhibits an excellent effect as to the prevention of such segregation.

Further, since no bulging is caused, center segregation can be stably removed.

What is claimed is:

1. A method of continuous casting by which a continuously cast strand having wide equiaxed crystal zone at the axial center portion thereof is drawn while being rolled down between confronting rolls, comprising the sequential steps of:

rolling down a casting so as to compensate the total amount of volume contraction by solidification and cooling of cast strand in a region from the position where the solid phase ratio at the central portion of the casting is 0.2 to the position where the solid phase ratio is 0.9; and continuously rolling down the casting at a ratio so that the rolling down gradient (%/m) corresponding to the ratio of the amount of rolling down (%) to the original thickness of the cast strand per unit length thereof in the drawing direction thereof is between 0.08%/m and 1.50%/m until solidification is finished.

2. A method of continuous casting according to claim 1 which is applied to the continuous casting of a bloom.

3. A method of continuous casting according to claim 1, wherein rolling down is executed by at least one rolling down roll having a rolling action exhibiting an effective length of 0.2 to 0.8 times that of the width of the casting to act on the casting from at least one of the upper and lower sides thereof in a region located after the time at which the center solid phase ratio becomes 0.35 to 0.45.

4. A method of continuous casting according to claim 1, wherein rolling down is executed by the rolling down gradient of 0.30 to 1.50%/m in a region where the solid phase ratio at the central portion of the casting exceeds 0.9.

* * * * *